US009296499B2

(12) United States Patent
Masuda et al.

(10) Patent No.: US 9,296,499 B2
(45) Date of Patent: Mar. 29, 2016

(54) LID SHAPING DEVICE

(75) Inventors: Tomoyuki Masuda, Tokyo (JP); Yoshifumi Miki, Itano-gun (JP); Takakazu Okamoto, Itano-gun (JP)

(73) Assignees: KABUSHIKI KAISHA YAKULT HONSHA, Tokyo (JP); SHIKOKU KAKOKI CO., LTD., Tokushima (JP)

( * ) Notice: Subject to any disclaimer, the term of this patent is extended or adjusted under 35 U.S.C. 154(b) by 805 days.

(21) Appl. No.: 13/578,144

(22) PCT Filed: Feb. 10, 2011

(86) PCT No.: PCT/JP2011/000739

§ 371 (c)(1),
(2), (4) Date: Oct. 31, 2012

(87) PCT Pub. No.: WO2011/102097

PCT Pub. Date: Aug. 25, 2011

(65) Prior Publication Data

US 2013/0036709 A1 Feb. 14, 2013

(30) Foreign Application Priority Data

Feb. 16, 2010 (JP) ..... 2010-031022

(51) Int. Cl.
*B65B 7/00* (2006.01)
*B65B 7/01* (2006.01)
*B65B 7/28* (2006.01)

(52) U.S. Cl.
CPC ..... *B65B 7/285* (2013.01)

(58) Field of Classification Search
None
See application file for complete search history.

(56) References Cited

U.S. PATENT DOCUMENTS 2,116,067 A * 5/1938 Gantzer ..... 53/358
3,332,211 A 7/1967 Koll et al.
4,099,361 A * 7/1978 Dix et al. ..... 53/488

(Continued)

FOREIGN PATENT DOCUMENTS

EP 1918219 A1 * 5/2008
JP 43-003982 Y1 2/1968
JP 49-037977 B 10/1974

(Continued)

OTHER PUBLICATIONS

Extended European Search Report dated Oct. 16, 2013, issued in corresponding European Patent Application No. 11744391.1.

(Continued)

*Primary Examiner* — Robert Long
*Assistant Examiner* — Tanzim Imam
(74) *Attorney, Agent, or Firm* — Westerman, Hattori, Daniels & Adrian, LLP

(57) ABSTRACT

The lid shaping device includes: container placing table 111; container lifter; lid shaping unit 112 including container mouth press 119, annular coil spring 123 arranged in a cylindrical holder, and pusher provided above the annular coil spring and having spring pressing inner circumferential surface 127; and pusher driver. The device operates in the order of first lifting by the container lifter until upper part or middle part of the lid skirt is located on the inner side of the annular coil spring, lowering of the pusher for lowering the container until the spring pressing inner circumferential surface reduces the diameter of the annular coil spring, and second lifting by the container lifter for lifting the container until the lower end of the lid skirt is located on the inner side of the annular coil spring.

5 Claims, 4 Drawing Sheets

(56) References Cited

U.S. PATENT DOCUMENTS

| | | | |
|---|---|---|---|
| 5,588,283 | A | 12/1996 | Martin |
| 2003/0177629 | A1 | 9/2003 | Thibault et al. |

FOREIGN PATENT DOCUMENTS

| | | | |
|---|---|---|---|
| JP | 63-212019 | A | 9/1988 |
| JP | 2002-0225902 | A | 8/2002 |
| JP | 2004-074794 | A | 3/2004 |
| JP | 2004-075196 | A | 3/2004 |
| JP | 2004-075197 | A | 3/2004 |
| JP | 2005-343507 | A | 12/2005 |
| JP | 2005-343508 | A | 12/2005 |
| NL | 7410556 | A | 1/1976 |

OTHER PUBLICATIONS

International Search Report of PCT/JP2011/000739, mailing date of May 17, 2011.

International Preliminary Report on Patentability for PCT/JP2011/000739, mailing date of Sep. 27, 2012.

* cited by examiner

LID SHAPING DEVICE

TECHNICAL FIELD

The present invention relates to a lid shaping device that shapes a lid skirt of a sealed container hermetically sealed by covering a bottomed cylindrical container body made of synthetic resin, which is filled with liquid contents, with a molded lid made of synthetic resin having a suspended lid skirt from the peripheral edge of a disc-like lid body and relates to a liquid filling machine comprising such a lid shaping device.

BACKGROUND ART

A known conventional filling and packaging machine of this type includes a container vertically adjusting device that vertically adjusts a bottomed cylindrical container body made of synthetic resin, which is supplied in an arbitrary orientation, such that an upper end opening thereof faces up and supplies the bottomed cylindrical container body to a subsequent process, a filling device that fills the container supplied from the container vertically adjusting device with contents, a lid supplying device that covers the upper end opening of the container, which is filled with the contents, with a lid substantially C-shaped in cross section, and a sealing device that heats the lid and seals the container upper opening with the lid (see for example, Patent Document 1).

After peeling the lid of the bottomed cylindrical container body made of synthetic resin, a consumer sometimes directly puts his/her mouth on the container opening and drinks the contents. Therefore, in order to keep the periphery of the container opening sanitary, in the bottomed cylindrical container body made of synthetic resin, a lid configured to protect this portion, i.e., a lid (substantially C-shaped in cross section) consisting of a disc-like lid body that covers the container upper end opening and a skirt provided to be suspended from a lid body peripheral edge is used.

A known filling and packaging machine for producing the contents-filled container covered with the lid substantially C-shaped in cross section pays attention to excellent moldability and shape retainability of an aluminum foil, and includes a lid punching and molding device that uses a sheet-like lid material obtained by laminating a heat seal layer and the like on the aluminum foil, punches a disc-like lid from the lid material, and molds the disc-like lid into a lid substantially C-shaped in cross section immediately after the punching, and a lid supplying device that supplies the molded lid substantially C-shaped in cross section to an opening of the container being conveyed and covers the opening with the lid (see for example, Patent Document 2). However, a metal detector for inspecting an entire product cannot be used on the container including such a lid material having the aluminum foil layer as a base material. Therefore, the problem is that it is not possible to detect metals that may be mixed in the contents such as a nail, a staple, a broken piece of a molded product punching blade, a bolt and a nut, a wire, and a spring. Such containers including the aluminum lids have a drawback in that it is necessary to separately collect the aluminum lid and the container body made of synthetic resin such as polystyrene, which leads to a poor recyclability.

On the other hand, in order to solve such a problem, the present inventors have proposed, as a substitute for the lid material including the aluminum foil layer, a lid consisting of a laminated film including only a synthetic resin layer and not including an aluminum foil layer (see for example, Patent Document 3). Such a lid advantageously consists of a combination including only the synthetic resin layer and highlydeveloped lid shape. The problems, however, are that a lid material has to be heated and molded in order to form the lid, a lid material forming device is expensive and bulky and, in terms of temperature management of a heating zone for heating the lid material, it is difficult to combine a lid molding device with a filling and packaging machine in a continuous process.

Therefore, in order to solve the problem, the present inventors repeatedly conducted researches on lid materials and succeeded in the development of a lid material made of synthetic resin that can be molded by cold drawing (see for example, Patent Document 4). The present inventors have proposed a container in which such a lid material made of synthetic resin that can be molded by the cold drawing is used, i.e., a sealed container including a resin container and a lid fixedly attached to the resin container in which the lid is obtained by cold-molding a polystyrene resin sheet with propagation energy equal to or larger than 0.015 J in a sheet having thickness of 150 μm measured by a falling weight impact test method conforming to ASTM D3763 and has shape retainability (see for example, Patent Document 5). The present inventors have proposed a sealed container including a resin container and a lid fixedly attached to the resin container in which the lid is produced by cold-molding a resin sheet for cold molding including a base material layer containing polystyrene resin containing high impact polystyrene (HIPS) or a composite consisting of high impact polystyrene and styrene-butadiene copolymer and has shape retainability (see for example, Patent Document 6).

Further, using the lid made of synthetic resin obtained by the cold molding and in order to obtain a product container equivalent to a conventional product container whose lid material including the aluminum foil layer as the base material, the present inventors have proposed a lid molding device including squeezing means or squeezing/twisting means for a lid skirt of a sealed container (see Patent Document 7).

PRIOR ART DOCUMENTS

Patent Documents

Patent Document 1: Japanese Patent Publication No. 49-37977

Patent Document 2: Japanese Unexamined Patent Application Publication No. 63-212019

Patent Document 3: Japanese Unexamined Patent Application Publication No. 2002-225902

Patent Document 4: Japanese Unexamined Patent Application Publication No. 2004-74794

Patent Document 5: Japanese Unexamined Patent Application Publication No. 2004-75197

Patent Document 6: Japanese Unexamined Patent Application Publication No. 2004-75196

Patent Document 7: Japanese Unexamined Patent Application Publication No. 2005-343507

SUMMARY OF THE INVENTION

Object to be Solved by the Invention

However, the lid molding device including the squeezing means or the squeezing/twisting means for the lid skirt of the sealed container inserts a primarily-molded container into a recess sized to the outer diameter of a cap and performs molding. The skirt is at most perpendicular to a lid upper surface. When the diameter near a container mouth is about the same as the bore of the upper end of the container, no problem occurs. However, in the case of a slim container, the diameter near a container mouth is smaller than the bore of the upper end thereof, and a problem is caused in that the container has an impression that the skirt widens and has an unpleasant appearance.

It is an object of the present invention to provide a lid shaping device that can produce a sealed container having a pleasant appearance in which a gap is not formed between the side surface of a container mouth and a skirt even when a container body slimmed near a container mouth is used, a liquid filling machine including such a lid shaping device, and the like.

Means to Solve the Object

As a result of earnestly examining the object in order to solve the object, the present inventors found that, by performing shaping of a lid skirt in a two-step motion of caulking an upper part or a middle part of the lid skirt using an annular coil spring, moving a container in that state, and caulking the lid skirt to a lower part thereof, the lid skirt of a lid made of synthetic resin can be reliably folded to the inner side at the upper end of a side circumferential outer surface of a container body slimmed near a container mouth and a lid shape after the shaping is an extremely well-featured shape which completes the present invention.

The present invention relates to (1) a lid shaping device that shapes a lid skirt of a sealed-container hermetically sealed by covering a bottomed cylindrical container body made of synthetic resin filled with liquid contents, with a molded lid made of synthetic resin having the lid skirt suspended from a peripheral edge of a disc-like lid body, the lid shaping device comprising:

a container placing table on which the sealed container is placed;

a container lifting and lowering means for lifting and lowering the container placing table;

a lid shaping unit arranged on an upper side of the container placing table, the lid shaping unit comprising a cylindrical holder having, a fitting recess in which the lid skirt of the sealed container can be fit in a center of the bottom part, an annular coil spring supported on a bottomed outer edge of the cylindrical holder and capable of expanding and contracting to caulk the lid skirt of the sealed container, a pusher capable of rising and falling, provided on an upper side of the annular coil spring, having a tapered spring pressing inner circumferential surface inclining toward an upper center at its lower end that can reduce a diameter of the annular coil spring when lowering, and a container mouth pressing means provided in the fitting recess of the cylindrical holder, including a container mouth pressing member at its lower end, urged downward and capable of rising and falling; and a pusher lifting and lowering means for lifting and lowering the pusher of the lid shaping unit, wherein the container lifting and lowering means is a means for lowering the sealed container after performing a first lifting for lifting the sealed container until an upper part or a middle part of the lid skirt is located on an inner side of the annular coil spring and a second lifting for lifting the sealed container until a lower part of the lid skirt is located on the inner side of the annular coil spring, the pusher lifting and lowering means is a means for, after lowering the pusher until the spring pressing inner circumferential surface reduces the diameter of the annular coil spring, lifting the pusher until the spring pressing inner circumferential surface releases the annular coil spring from the diameter reduction, and the device operates in the order of the first lifting of the sealed container, the lowering of the pusher, the second lifting of the sealed container, the lifting of the pusher, and the lowering of the sealed container, (2) the lid shaping device according (1), wherein the container lifting and lowering means is a lower cam including a first rising step and a second rising step, the lower cam being engaged with a cam follower provided in the container placing table to guide the container placing table, and the pusher lifting and lowering means is an upper cam including a falling step provided between the first rising step and the second rising step, the upper cam being engaged with a cam follower provided in the pusher of the lid shaping unit to guide the pusher, (3) the lid shaping device according to (1) or (2), comprising a heating means for heating the lid skirt before the shaping, (4) a liquid filling and packaging machine comprising:

the lid shaping device according to any one of (1) to (3);

a container supplying device that supplies a bottomed cylindrical container body made of synthetic resin to a filling device;

wherein the filling device fills the supplied container body with contents;

a primary lid cold molding device that molds a molded lid made of synthetic resin including a skirt suspended from a peripheral edge of a lid body from a sheet-like lid material;

a lid supplying device that supplies the molded lid to an upper end opening of the container body filled with the contents; and a sealing device that seals the upper end opening of the container body with the molded lid to form a sealed container, wherein the container supplying device, the filling device, the primary lid cold molding device, and the lid supplying device are provided upstream of the lid shaping device, and (5) the liquid filling and packaging machine according to (4), wherein the sealing device is an ultrasonic sealing device that, while the container body on which the molded lid is placed rotationally moves, ultrasonically seals the upper end opening of the container body with the molded lid to form a sealed container.

The present invention relates to (6) a method for producing a lid shaped sealed container comprising shaping a lid skirt using the lid shaping device according to any one of (1) to (3), after covering a bottomed cylindrical container body made of synthetic resin filled with liquid contents with a molded lid made of synthetic resin including the lid skirt suspended from a peripheral edge of a disc-like lid body to hermetically seal the bottomed cylindrical container body, the method comprising:

a container placing step for placing the sealed container on a container placing table;

a first container lifting step for lifting the sealed container placed on the container placing table with a container lifting and lowering means, fitting the lid skirt of the sealed container in a cylindrical holder fitting recess of a lid shaping unit arranged on an upper side of the container placing table, and locating an upper part or a middle part of the lid skirt of the sealed container on an inner side of an annular coil spring in the cylindrical holder;

a pusher lowering step for lowering a pusher in the cylindrical holder with a pusher lifting and lowering means in a state in which the upper part or the middle part of the lid skirt of the sealed container is located on the inner side of the annular coil spring, reducing a diameter of the annular coil spring with a spring pressing inner circumferential surface, and caulking the lid skirt from an outer side; and a second container lifting step for further lifting the sealed container with the container lifting and lowering means in a state in which the lid skirt is caulked from the outer side by the annular coil spring, and caulking a lower part of the lid skirt with force stronger than the caulking in the pusher lowering step, (7) the method for producing the lid shaped sealed container according to (6), comprising a heating step for heating the lid skirt before the shaping before or after the container placing step, and (8) the method for producing the lid shaped sealed container according to (6) or (7), further comprising, after the second container lifting step, a retaining step for retaining a state in which a lower end of the lid skirt is pressed from an outside with the annular coil spring.

Effect of the Invention

With the lid shaping device according to the present invention, it is possible to produce a sealed container having a pleasant appearance in which a gap is not formed between the upper end of the side circumferential outer surface of a container body and a lid skirt even if the sealed container is a slim container, the diameter near a container mouth of which is smaller than the bore of the upper end thereof.

MODE OF CARRYING OUT THE INVENTION

Figure 1:
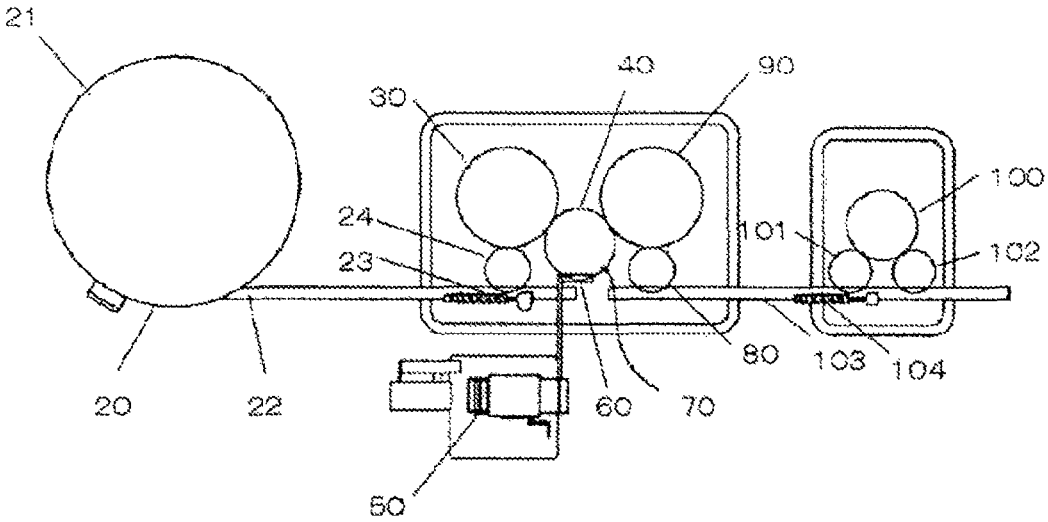
FIG. 1 is an overall plan view showing an embodiment of a liquid filling and packaging machine including a lid shaping device according to the present invention.

A lid shaping device according to the present invention is not specifically limited as long as the lid shaping device is a lid shaping device that shapes a lid skirt of a sealed container hermetically sealed by covering a bottomed cylindrical container body made of synthetic resin, which is filled with liquid contents, with a molded lid made of synthetic resin having a lid skirt suspended from a peripheral edge of a disc-like lid body, the lid shaping device including: a container placing table on which the sealed container is placed; a container lifting and lowering means for lifting and lowering the container placing table; a lid shaping unit arranged on an upper side of the container placing table, the lid shaping unit comprising a cylindrical holder having a fitting recess in which the lid skirt of the sealed container can be fit in a center of the bottom part, an annular coil spring supported on a bottomed outer edge of the cylindrical holder and capable of expanding and contracting to caulk the lid skirt of the sealed container, a pusher capable of rising and falling, provided on an upper side of the annular coil spring, having a tapered spring pressing inner circumferential surface inclining toward an upper center at its lower end that can reduce the diameter of the annular coil spring when lowering, urged upward, and capable of rising and falling, and a container mouth pressing means provided in the fitting recess of the cylindrical holder, including a container mouth pressing member at the lower end thereof, urged downward, and capable of rising and falling; and a pusher lifting and lowering means for lifting and lowering the pusher of the lid shaping unit, wherein the container lifting and lowering means is a means for lowering the sealed container after performing a first lifting for lifting the sealed container until an upper part or a middle part of the lid skirt is located on the inner side of the annular coil spring and a second lifting for lifting the sealed container until a lower part of the lid skirt is located on the inner side of the annular coil spring, the pusher lifting and lowering means is a means for, after lowering the pusher until the spring pressing inner circumferential surface reduces the diameter of the annular coil spring, lifting the pusher until the spring pressing inner circumferential surface releases the annular coil spring from the diameter reduction, and the device operates in the order of the first lifting of the sealed container, the lowering of the pusher, the second lifting of the sealed container, the lifting of the pusher, and the lowering of the sealed container. It is desirable in terms of productivity of a liquid filled sealed container that a plurality of sets of the container placing tables and the lid shaping units in the lid shaping device according to the present invention are provided. Such a plurality of the container placing tables and the lid shaping units may be linearly provided at equal intervals. However, it is desirable to rotatably provide the container placing tables and the lid shaping units at equal intervals because shaping of lids can be continuously performed. The lid shaping device according to the present invention can be used while being mounted on, for example, a liquid filling and packaging machine including, upstream of the lid shaping device, a container supplying device that supplies a bottomed cylindrical container body made of synthetic resin to a filling device, the filling device that fills the supplied container body with contents, a primary lid cold molding device that molds, from a sheet-like lid material, a molded lid made of synthetic resin including a skirt suspended from a peripheral edge of a lid body, a lid supplying device that supplies the molded lid to an upper end opening of the container body filled with the contents, and a sealing device that seals the upper end opening of the container body with the molded lid to form a sealed container.

As the container placing table on which the sealed container is placed, for example, a placing table including a container holder on which the sealed container can be stably placed to be capable of being lifted and lowered can be illustrated. A container lifting and lowering means for lifting and lowering such a container placing table is not specifically limited as long as the container lifting and lowering means is a means for lowering the sealed container after performing a first lifting for lifting the sealed container until an upper part or a middle part of the lid skirt is located on the inner side of the annular coil spring and a second lifting for lifting the sealed container until at least a lower part of the lid skirt is located on the inner side of the annular coil spring. For example, a means in which an actuator such as an air cylinder is used or means in which a cam mechanism is used can be illustrated. The container lifting and lowering means is desirably the means in which a cam mechanism is used because the means can more reliably achieve lifting and lowering. As a cam (a lower cam) functioning as such container lifting and lowering means, for example, a cam including a first rising step and a second rising step that engages with a cam follower provided in the container placing table and guides the container placing table can be illustrated. In order to reliably engage the cam (the lower cam) and the cam follower, it is desirable to provide the container placing table while being urged upward. The cam (the lower cam) can be linearly or circumferentially provided along a conveying path. Depending on the length of the lid skirt, it is desirable to lift, with the second rising step, the sealed container 0.5 to 1.5 mm more than lifting by the first rising step.

The lid shaping unit is arranged above the lid placing table to be opposed to the lid placing table. The lid shaping unit includes a cylindrical holder, an annular coil spring, a pusher, and a container mouth pressing means. The cylindrical holder includes a bottomed outer edge that can support the annular coil spring and includes, in the bottom center, a fitting recess formed by the bottomed outer edge in which the lid skirt of the sealed container can be fit. The annular coil spring can expand and contract to caulk the lid skirt of the sealed container. The annular coil spring is supported on the bottomed outer edge of the cylindrical holder and is in contact with the lower inner circumferential surface of the cylindrical holder when the pusher is present in a lifted position. The annular coil spring has an inner diameter equal to or slightly larger than the diameter of the lid. The pusher is provided, in a state in which the pusher is urged upward, above the annular coil spring to be slidable against the inner circumferential surface of the cylindrical holder. The pusher includes, at the lower end thereof, a tapered spring pressing inner circumferential surface inclining toward the upper center that can reduce, when lowered, the diameter of the annular coil spring. Specifically, the diameter of the spring pressing inner circumferential surface in contact with the annular coil spring decreases according to the falling of the pusher, whereby the diameter of the annular coil spring decreases and the lid skirt located on the inner side of the annular coil spring can be caulked from the outer side. The container mouth pressing means is provided in the fitting recess of the cylindrical holder. The container mouth pressing means includes a container mouth pressing member at the lower end thereof. The container mouth pressing member is urged downward by an elastic member such as a coil spring. However, when a mouth upper surface (a flange section upper surface) of the sealed container is brought into contact with the lower end surface of the container mouth pressing member by the container lifting and lowering means and the sealed container further rises in that state, the lid skirt of the sealed container rises against a downward urging force by the elastic member of the container mouth pressing means until the lid skirt is located on the inner side of the annular coil spring. However, when the sealed container is lowered by the container lifting and lowering means, the container mouth pressing member is also lowered by the downward urging force to push down the mouth upper surface of the sealed container. The sealed container can be reliably detached from the lid shaping unit onto the container placing table.

The pusher lifting and lowering means that lifts and lowers the pusher is not specifically limited as long as the pusher lifting and lowering means is a means for, after lowering the pusher until the spring pressing inner circumferential surface reduces the diameter of the annular coil spring by a predetermined amount while sliding the pusher against the inner circumferential surface of the cylindrical holder, lifting the pusher until the spring pressing inner circumferential surface releases the annular coil spring from the diameter reduction (expands the annular coil spring to the size before the diameter reduction). Like the container lifting and lowering means, for example, a means in which an actuator such as an air cylinder is used or a means in which a cam mechanism is used can be illustrated. The pusher lifting and lowering means is desirably the means in which the cam mechanism is used because the means can more reliably achieve lifting and lowering. As a cam (an upper cam) functioning as such pusher lifting and lowering means, for example, a cam including a falling step provided between a first rising step and a second rising step of the container lifting and lowering means that engages with a cam follower provided in the pusher of the lid shaping unit and guides the pusher can be illustrated. Like the lower cam, the cam (the upper cam) can be linearly or circumferentially provided along the conveying path.

In the lid shaping device according to the present invention, the container lifting and lowering means and the pusher lifting and lowering means are configured or controlled such that the lid shaping device operates in the order of the first lifting of the sealed container by the container lifting and lowering means, the lowering of the pusher by the pusher lifting and lowering means, the second lifting of the sealed container by the container lifting and lowering means, the lifting of the pusher by the pusher lifting and lowering means, and the lowering of the sealed container by the container lifting and lowering means. Specifically, the upper part or the middle part of the lid skirt is located on the inner side of the annular coil spring by the first lifting of the container by the container lifting and lowering means and the spring pressing inner circumferential surface reduces the diameter of the annular coil spring by a predetermined amount according to the lowering of the pusher by the pusher lifting and lowering means and the upper part or the middle part of the lid skirt is caulked from the outer side. Further, the second lifting of the container by the container lifting and lowering means is performed in that state, whereby the upper part or the middle part to the lower part (the lower end) of the lid skirt are continuously caulked. The shaping of the lid skirt is performed in a two-step motion in this way. Consequently, even when a lid made of synthetic resin in a slim container having the diameter near a container mouth smaller than the bore of the upper end thereof is shaped, it is possible to reliably fold the lid skirt to the inner side at the upper end on a side circumferential outer surface of a container body to form the lid skirt in a well-featured shape in which a gap is not formed. It is possible to reliably retain this well-featured shape.

The lid shaping device according to the present invention desirably further includes a heating means for heating the lid skirt before the shaping. The heating means may be provided upstream of the container placing table or may be provided on the container placing table. When the heating means is provided upstream of the container placing table, a heating means such as a means for jetting hot air to the lid skirt of the sealed container conveyed from a side of the conveying path while rotating can be illustrated.

A method for producing a sealed container according to the present invention is not specifically limited as long as the method is a method for, after covering a bottomed cylindrical container body made of synthetic resin, which is filled with liquid contents, with a molded lid made of synthetic resin including a lid skirt suspended from a peripheral edge of a disc-like lid body to hermetically seal the bottomed cylindrical container body, shaping the lid skirt of the sealed container using the lid shaping device according to the present invention, the method including: a container placing step for placing the sealed container on a container placing table; a first container lifting step for lifting, with a container lifting and lowering means, the sealed container placed on the container placing table, fitting the lid skirt of the sealed container in a cylindrical holder fitting recess of a lid shaping unit arranged above the container placing table, and locating an upper part or a middle part of the lid skirt of the sealed container on the inner side of an annular coil spring in the cylindrical holder; a pusher lowering step for, in a state in which the upper part or the middle part of the lid skirt of the sealed container is located on the inner side of the annular coil spring, lowering, with a pusher lifting and lowering means, a pusher in the cylindrical holder, reducing the diameter of the annular coil spring with a spring pressing inner circumferential surface, and caulking the lid skirt from the outer side; and a second container lifting step for, in a state in which the lid skirt is caulked from the outer side by the annular coil spring, further lifting the sealed container with the container lifting and lowering means and caulking a lower part of the lid skirt with force stronger than the caulking in the pusher lowering step. However, usually, a step for lifting the pusher and lowering the sealed container is provided following the container placing step, the first container lifting step, the pusher lowering step, and the second container lifting step.

The lid shaping method according to the present invention desirably includes, before or after the container placing step, a heating step for heating the lid skirt before the shaping. The lid shaping method more desirably includes, after the second container lifting step, a retaining step for retaining a state in which the lower end of the lid skirt is pressed from the outer side by the annular coil spring. In the retaining step, the heated lid can be cooled in a state in which the lid skirt is caulked. Therefore, it is possible to mold the lid skirt in a state in which the lid skirt is more reliably folded. It is possible to more reliably maintain the state even after molding.

The container body made of synthetic resin and the molded lid made of synthetic resin that can be applied in the lid shaping device and the lid shaping method according to the present invention mean a container body and a lid mainly containing the synthetic resin. Besides, the container body and the molded lid may include a charge prevention layer, a gas barrier layer, a printed layer, and the like containing components other than the synthetic resin. As such synthetic resin serving as the main component of the container body and the lid, thermoplastic resin such as polyethylene, polypropylene, polystyrene, AS resin, and ABS resin can be illustrated. Types of the synthetic resins used in the container body and the lid may be different from each other. However, the synthetic resins are desirably resin of the same type in terms of recyclability. Specifically, as the container body and the lid made of synthetic resin in the present invention, container bodies and lids described in pending Japanese Patent Application Publication No. 2004-74795, pending Japanese Patent Application Publication No. 2004-74796, pending Japanese Patent Application Publication No. 2004-75196, pending Japanese Patent Application Publication No. 2004-75197, and pending Japanese Patent Application Publication No. 2004-154957 are suitably illustrated. The container bodies and the lids include a container body made of polystyrene resin, a lid obtained by cold-molding a polystyrene resin sheet with propagation energy equal to or larger than 0.015 J in a sheet having thickness of 150 μm measured by a falling weight impact test method conforming to ASTM D3763, and a lid obtained by cold-molding a resin sheet for cold molding including a base material layer containing polystyrene resin containing high impact polystyrene (HIPS) or a composite consisting of high impact polystyrene and styrene-butadiene copolymer.

Figure 2:
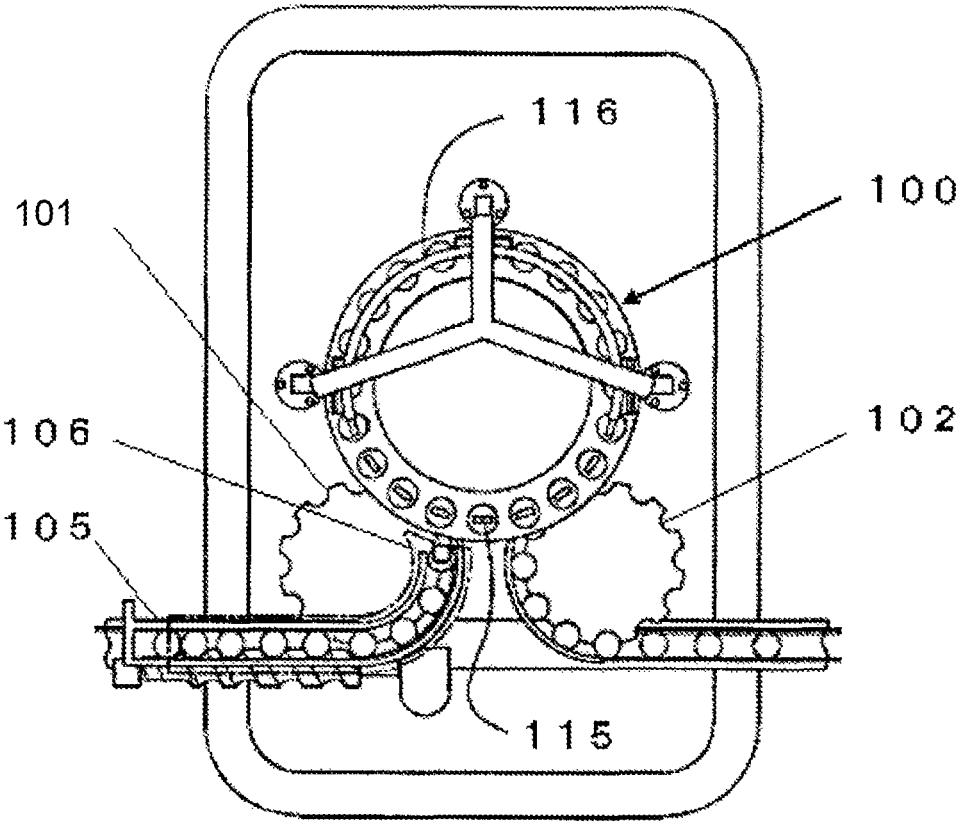
FIG. 2 is a plan view of the lid shaping device in the filling and packaging machine shown in FIG. 1.
Figure 3:
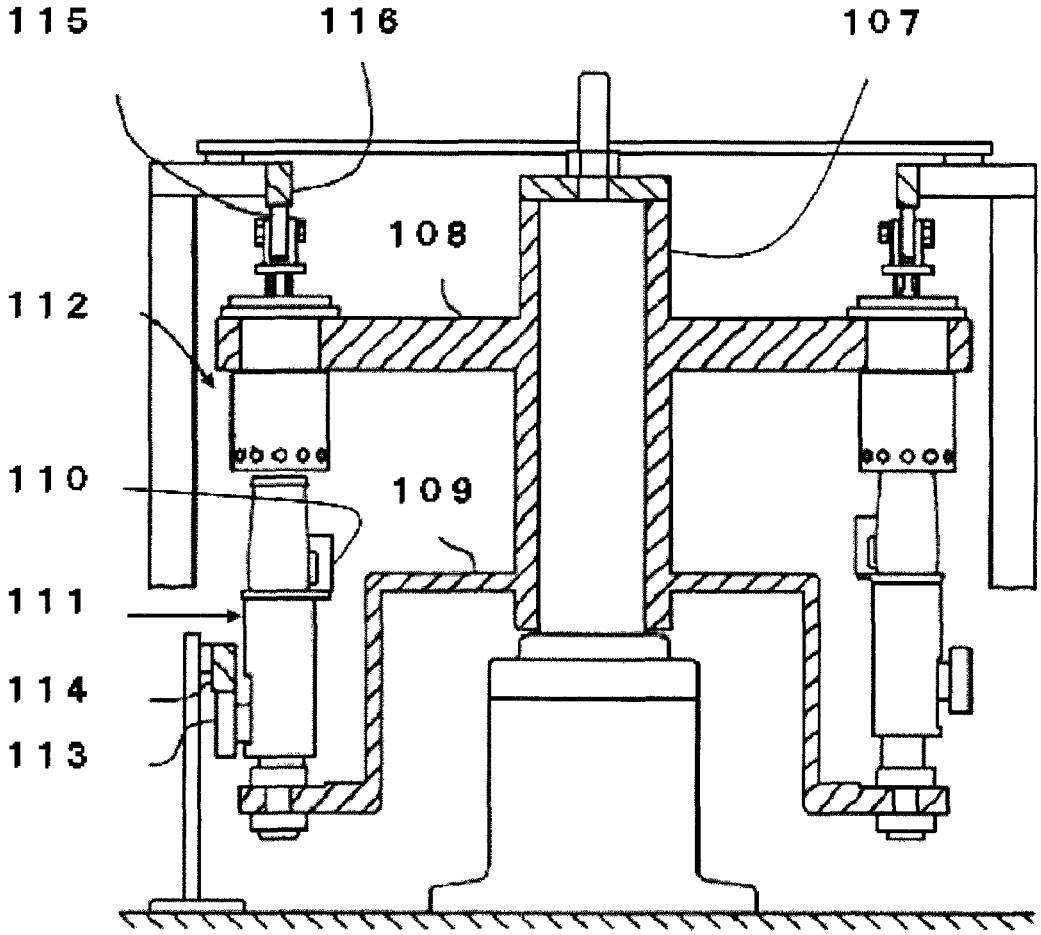
FIG. 3 is a sectional view of a lid shaping device body in the lid shaping device shown in FIG. 2.
Figure 4:
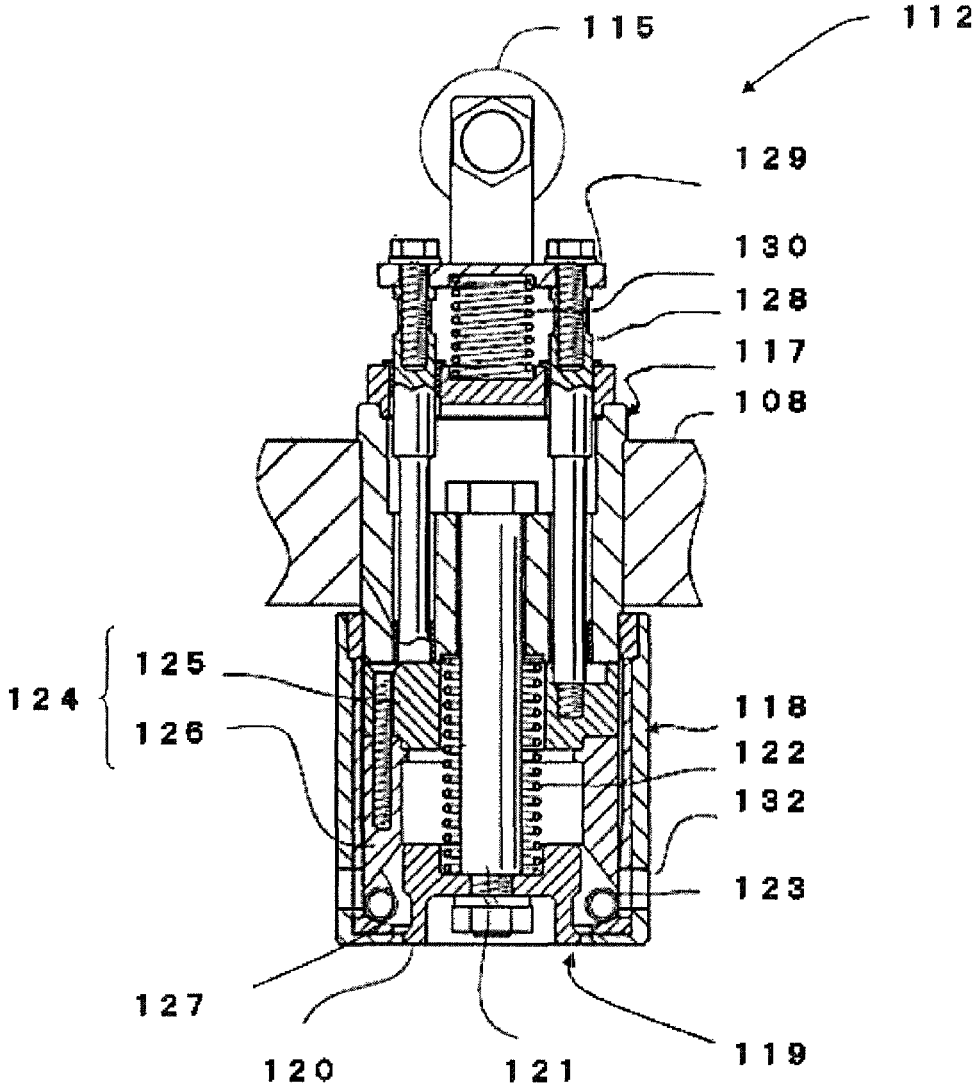
FIG. 4 is a sectional view of a lid shaping unit in the lid shaping device body shown in FIG. 3.
Figure 5:
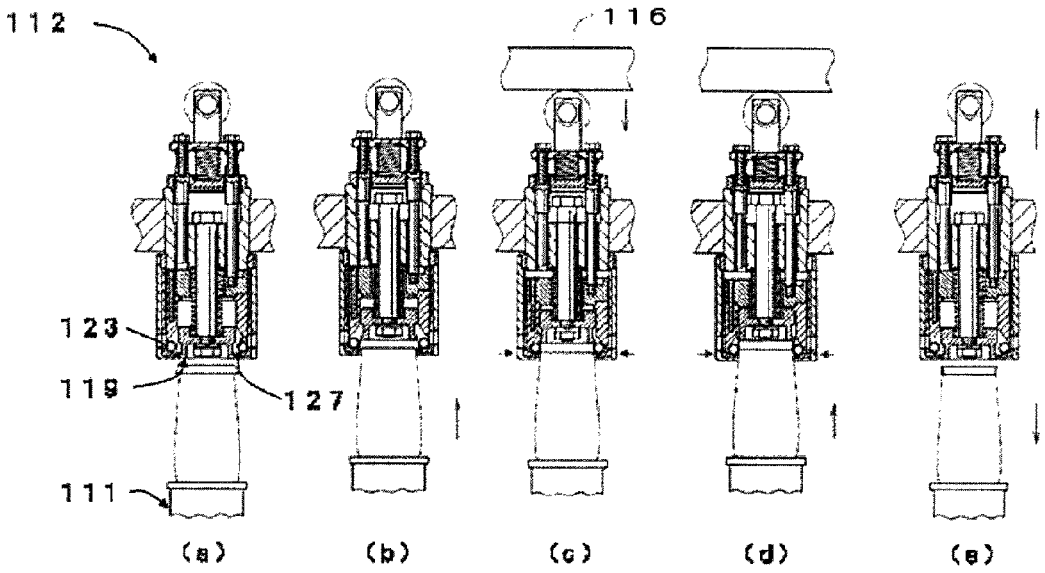
FIG. 5 is an operation explanatory diagram showing the operation of the lid shaping device shown in FIG. 1.

The present invention is more specifically explained below with reference to embodiments. However, the technical scope of the present invention is not limited to these illustrations. FIG. 1 is an overall plan view showing an embodiment of a liquid filling and packaging machine including the lid shaping device according to the present invention. FIG. 2 is a plan view of the lid shaping device. FIG. 3 is a sectional view of a lid shaping device body. FIG. 4 is a sectional view of a lid shaping unit. FIG. 5 is an operation explanatory diagram showing the operation of the lid shaping device.

As shown in FIG. 1, the liquid filling and packaging machine including the lid shaping device according to the present invention includes a container supplying device 20 that supplies a bottomed cylindrical container body made of synthetic resin to a filling device, a filling device 30 that fills the supplied container body with contents, a primary lid cold molding device 50 that molds, from a sheet-like lid material, a molded lid made of synthetic resin including a skirt suspended from a peripheral edge of a lid body, a lid supplying device 60 that supplies the molded lid to an upper end opening of the container body filled with the contents, a sealing device 90 that seals the upper end opening of the container body with the molded lid to form a sealed container, and a lid shaping device body 100 that molds the molded lid of the sealed container into a final lid shape. The liquid filling and packaging machine has a production ability of 33,000 bottles per one hour.

The container supplying device 20 includes a container vertically adjusting device 21. The container vertically adjusting device 21 vertically adjusts bottle-like bottomed cylindrical container bodies made of synthetic resin, which are supplied in arbitrary orientations, such that upper end openings thereof face up and places the bottomed cylindrical container bodies on a conveyor 22 in a row. The container bodies placed on the conveyor 22 are conveyed to a downstream side and aligned at a predetermined pitch by a screw conveyor 23 in a conveyor downstream section. The aligned container bodies are supplied to the filling device 30 via an inlet stir wheel 24. In the filling device 30, liquid contents are filled in a container from forty vacuum filling nozzles (not shown in the figure) while the container rotationally moves in the device. The container filled with the liquid contents is transferred to an intermediate stir wheel 40.

The primary lid cold molding device 50 is provided near the filling device 30. The primary lid cold molding device 50 punches a sheet-like lid material made of synthetic resin in a substantially disc shape and molds the punched lid material into a molded lid consisting of a lid body having a substantially C shape in cross section, i.e., a disc shape and a skirt provided to be suspended from the peripheral edge of the lid body. The molded lid is laid over the upper end opening of the container body, which is conveyed by the intermediate stir wheel 40, by the lid supplying device 60.

Subsequently, the container filled with the contents is supplied from the intermediate stir wheel 40 to the ultrasonic sealing device 90. In the ultrasonic sealing device 90, a container on which the molded lid is determined as being normally placed by the lid detecting device 70 is ultrasonically sealed and hermetically sealed with the molded lid while the container moves in the sealing device. The container is conveyed to a conveyor 103 via a container carrying-out device 80. Sealed containers placed on the conveyor 103 are conveyed to the downstream side and aligned at a predetermined pitch by a screw conveyor 104 in a conveyor downstream section. The aligned sealed containers are supplied to the lid shaping device body 100 via an inlet stir wheel 101. The lid shaping device body 100 secondarily molds, while the sealed container moves in the device (turns around), the molded lid sealing the container body and forms a sealed container having a final shape. The sealed container having the final shape is conveyed to the next process via an outlet stir wheel 102.

As shown in FIG. 2, a pipe-like hot air nozzle (heating means) 105 provided along the lid skirt of the container being conveyed is provided upstream of the lid shaping device body 100. A hot air blowing hole faced to the lid skirt is provided in the hot air nozzle 105. There is a speed difference between conveying speed of the conveyor 103 and conveying speed of the screw conveyor 104. The sealed containers being aligned by the screw conveyor 104 are rotated according to the speed difference. The sealed containers being conveyed by the inlet stir wheel 101 are also rotated according to frictional resistance with a guide. According to the rotation of the sealed containers, the entire circumferential surfaces of the lid skirts of the containers can be uniformly heated. The hot air nozzle 105 is desirably provided on both sides in a container conveying direction in order to increase the ability (the speed) of the filling and packaging machine. A hot air cover 106 is provided above a container conveying path from the screw conveyor 104 to the inlet stir wheel 101. The lid shaping device according to the present invention is explained in detail below.

As shown in FIG. 2, the lid shaping device includes the rotary-type lid shaping device body 100 having an arcuate shape in plan view. As shown in FIG. 3, the lid shaping device body 100 includes an upper rotation supporting plate 108 and a lower rotation supporting plate 109 fixed to a driving shaft 107 in the center. Twenty container placing tables 111 comprising container holders 110 are provided at the peripheral edge of the lower rotation supporting plate 109 at equal intervals. In the upper rotation supporting plate 108, twenty lid shaping units 112 are provided in positions opposed to the container placing tables 111 above the container placing tables 111. The lid shaping device body 100 includes a lower cam (container lifting and lowering means) 114 that engages with a lower cam follower 113 provided on a side part of the container placing table 111 and an upper cam (pusher lifting and lowering means) 116 that engages with an upper cam follower 115 provided in an upper part of the lid shaping unit 112. In this embodiment, the container placing table 111 is provided to be urged upward. At a start point and an end point, the container placing table 111 is pressed downward by the lower cam 114 (see the left of FIG. 3).

The lower cam 114 is provided on the outer side along the arcuate lower rotation supporting plate 109 to be capable of engaging with the lower cam follower 113 of the container placing table 111. As explained above, at the start point, the lower cam 114 is located downward. The lower cam 114 includes, along a traveling direction, a first rising step (upward inclination) and a second rising step (upward inclination). Downstream of the second rising step, the lower cam 114 is interrupted once. In such a position, the container placing table 111 is urged to an upper limit (see the right of FIG. 3). Downstream of the position, a lowering step (downward inclination) for lowering the lower cam 114 by total height of the first rising step and the second rising step is provided. The lower cam 114 reaches the same height at the start point and is connected to the start point.

The upper cam 116 is provided in a semi-arcuate shape above the outer circumference of the arcuate upper rotation supporting plate 108 and in the middle of the lid shaping path (see FIG. 2) to be capable of engaging with the upper cam follower 115 provided in the upper part of the lid shaping unit 112. The upper cam 116 includes a falling step (downward inclination) at a start end of the upper cam 116 and includes a rising step (upward inclination) having height same as the height of the falling step at a terminal end. The falling step at the start end of the upper cam 116 is provided downstream of the first rising step of the lower cam 114 and upstream of the second rising step of the lower cam 114. The rising step at the terminal end is provided downstream of the second rising step of the lower cam 114 and upstream of the falling step of the lower cam 114.

As shown in FIG. 4, the lid shaping unit 112 is a cylindrical unit surrounded by an upper holder 117 and a lower holder 118. The upper holder 117 is fixed to the upper rotation supporting plate 108 of the lid shaping device body 100. A fitting recess in which the lid skirt of the sealed container can be fit is provided in the bottom center of the lower holder 118. A bottomed outer edge for supporting the annular coil spring 123 is provided at the lower end of the lower holder 118. In the center of the lid shaping unit 112, container mouth pressing means 119 is extended from the center to the fitting recess. Such container mouth pressing means 119 includes a container mouth pressing member 120 located at the lower end of the container mouth pressing means 119 and formed in a concave shape in the center to receive the outer circumference (a flange section) of the top surface of the sealed container, a bolt 121 extending upward from the container mouth pressing member 120 piercing through the upper holder 117, including, at the other end, a stopper locked to the upper holder 117, and provided to be capable of rising and falling, and a lower spring 122 provided between the upper holder 117 and the container mouth pressing member 120. The container mouth pressing member 120 is urged downward. An annular coil spring 123 (an inner diameter: ϕ46 mm, a coil winding diameter: ϕ8 mm, a wire diameter: ϕ0.9 mm, the number of turns: 100) that can expand and contract to caulk the lid skirt of the sealed container is provided on the bottomed outer edge of the lower holder 118.

Above the annular coil spring 123, a pusher body 124 reverse-U shaped in cross section is provided to be capable of sliding in the cylindrical lower holder 118. Such a pusher body 124 includes a disc-like upper pusher 125 and a cylindrical lower pusher 126 and is formed in a taper shape (a taper angle of 38°) in which a lower surface (a spring pressing inner circumferential surface) 127 of the cylindrical lower pusher 126 inclines toward the upper center of the pusher body 124. When lowered, the pusher body 124 reduces the diameter of the annular coil spring 123. One end of a bolt 128 piercing through the upper holder 117 is coupled to the upper pusher 125 of the pusher body 124. An upper cam follower bracket 129 is coupled to the other end of such a bolt 128. The pusher body 124 and the upper cam follower 115 provided in the upper part of the lid shaping unit 112 mechanically operate together. An upper spring 130 is provided between the lower surface of the upper cam follower bracket 129 and the upper surface of the upper holder 117. The pusher body 124 is urged upward via the upper cam follower bracket 129. The upper cam follower bracket 129 falls when the upper cam follower 115 engages with the upper cam 116, presses the annular coil spring 123 from the outer side with the spring pressing surface 127, and reduces the diameter of the annular coil spring 123. Reference numeral 132 represents a cooling hole drilled in the circumferential surface of the cylindrical lower holder 118.

The operation of the lid shaping device configured as explained above is explained.

As shown in FIG. 5, first, the sealed container, the lid skirt of which is heated, is placed on the container placing table 111, which is pushed down and stopped (FIG. 5(*a*)). While the lower cam follower 113 of the container placing table 111 passes the first rising step of the lower cam 114, the container placing table 111 rises and the top of the sealed container on the container placing table 111 pushes up the container mouth pressing means 119 after fitting in the fitting recess of the lower holder and coming into contact with the circumferential lower end surface of the container mouth pressing member. At this point, the upper part or the middle part of the lid skirt is located on the inner side of the annular coil spring 123 (FIG. 5(*b*)). Subsequently, while the upper cam follower 115 of the lid shaping unit 112 engages with the upper cam 116 and passes the falling step, the upper cam follower bracket 129 falls. The spring pressing inner circumferential surface 127 of the lower pusher 126 reduces the diameter of the annular coil spring 123 by a predetermined length. Consequently, the upper part or the middle part of the lid skirt located on the inner side of the annular coil spring 123 is caulked from the outer side (FIG. 5(*c*)). In a state in which the lower pusher 126 is kept lowered, the lower cam follower 113 of the container placing table 111 passes the second rising step of the lower cam 114, whereby the container placing table 111 further rises and lifts the container while continuously caulking the upper part or the middle part to the lower part (the lower end) of the lid skirt (FIG. 5(*d*)). This state in which the lower end of the lid skirt is caulked is retained for a predetermined time to radiate the heat of the sealed container and cool the sealed container with the cooling hole 132. Thereafter, the upper cam follower 115 of the lid shaping unit 112 passes the rising step of the upper cam 116, whereby the lower pusher 126 rises and the annular coil spring 123 expands in the diameter to be restored and releases the lid skirt. At the same time, the lower cam follower 113 of the container placing table 111 passes the falling step of the lower cam 114 and the container placing table 111 falls to the original position. When the container placing table 111 falls, the container mouth peripheral edge is pushed down by the lowering of the container mouth pressing member 120 urged downward by the lower spring 122 provided between the upper holder 117 and the container mouth pressing member 120. The sealed container is reliably placed on the lowered container placing table 111 and lid shaping is completed (FIG. 5(*e*)). The operation explained above is performed while the sealed container turns around.

EXPLANATION OF LETTERS AND NUMERALS

20 container supplying device
21 container vertically adjusting device
22 conveyor
23 screw conveyor
24 inlet stir wheel
30 filling device
40 intermediate stir wheel
50 primary lid cold molding device
60 lid supplying device
70 lid detecting device
80 container carrying-out device
90 sealing device
100 lid shaping device body
101 inlet stir wheel
102 outlet stir wheel
103 conveyor
104 screw conveyor
105 pipe-like hot air nozzle
106 heat cover
107 driving shaft
108 upper rotation supporting plate
109 lower rotation supporting plate
110 container holder
111 container placing table
112 lid shaping unit
113 lower cam follower
114 lower cam (container lifting and lowering means)
115 upper cam follower
116 upper cam (pusher lifting and lowering means)
117 upper holder
118 lower holder
119 container mouth pressing means
120 container mouth pressing member
121 bolt
122 lower spring
123 annular coil spring
124 pusher body
125 upper pusher
126 lower pusher
127 lower surface (spring pressing inner circumferential surface)
128 bolt
129 upper cam follower bracket
130 upper spring
132 cooling hole

The invention claimed is:

1. A lid shaping device that shapes a lid skirt of a sealed-container hermetically sealed by covering a bottomed cylindrical container body made of synthetic resin filled with liquid contents, with a molded lid made of synthetic resin having the lid skirt suspended from a peripheral edge of a disc-like lid body, the lid shaping device comprising:

a container placing table on which the sealed container is placed;

a container lifting and lowering means for lifting and lowering the container placing table;

a lid shaping unit arranged on an upper side of the container placing table, the lid shaping unit comprising a cylindrical holder having a fitting recess in which the lid skirt of the sealed container can be fit in a center of the bottom part, an annular coil spring supported on a bottomed outer edge of the cylindrical holder and capable of expanding and contracting to caulk the lid skirt of the sealed container, a pusher capable of rising and falling, provided on an upper side of the annular coil spring, having a tapered spring pressing inner circumferential surface inclining toward an upper center at its lower end that can reduce a diameter of the annular coil spring when lowering, and a container mouth pressing means provided in the fitting recess of the cylindrical holder, including a container mouth pressing member at its lower end, urged downward and capable of rising and falling; and a pusher lifting and lowering means for lifting and lowering the pusher of the lid shaping unit, wherein the container lifting and lowering means is a means for lowering the sealed container after performing a first lifting for lifting the sealed container until an upper part or a middle part of the lid skirt is located on an inner side of the annular coil spring and a second lifting for lifting the sealed container until a lower part of the lid skirt is located on the inner side of the annular coil spring, wherein the container lifting and lowering means comprises a lower cam including a first rising step and a second rising step, the lower cam being engaged with a cam follower provided in the container placing table to guide the container placing table, the pusher lifting and lowering means is a means for, after lowering the pusher until the spring pressing inner circumferential surface reduces the diameter of the annular coil spring, lifting the pusher until the spring pressing inner circumferential surface releases the annular coil spring from the diameter reduction, wherein the pusher lifting and lowering means is an upper cam including a falling step provided between the first rising step and the second rising step, the upper cam being engaged with a cam follower provided in the pusher of the lid shaping unit to guide the pusher, and the device operates in the order of the first lifting of the sealed container, the lowering of the pusher, the second lifting of the sealed container, the lifting of the pusher, and the lowering of the sealed container.

2. A liquid filling and packaging machine comprising:

a lid shaping device that shapes a lid skirt of a sealed-container hermetically sealed by covering a bottomed cylindrical container body made of synthetic resin filled with liquid contents, with a molded lid made of synthetic resin having the lid skirt suspended from a peripheral edge of a disc-like lid body;

a container supplying device that supplies a bottomed cylindrical container body made of synthetic resin to a filling device;

the filling device that fills the supplied container body with contents;

a primary lid cold molding device that molds a molded lid made of synthetic resin including a skirt suspended from a peripheral edge of a lid body from a sheet-like lid material;

a lid supplying device that supplies the molded lid to an upper end opening of the container body filled with the contents; and a sealing device that seals the upper end opening of the container body with the molded lid to form a sealed container, wherein the container supplying device, the filling device, the primary lid cold molding device, the lid supplying device and the sealing device are provided upstream of the lid shaping device, wherein the lid shaping device comprises:

a container placing table on which the sealed container is placed;

a container lifting and lowering means for lifting and lowering the container placing table;

a lid shaping unit arranged on an upper side of the container placing table, the lid shaping unit comprising a cylindrical holder having a fitting recess in which the lid skirt of the sealed container can be fit in a center of the bottom part, an annular coil spring supported on a bottomed outer edge of the cylindrical holder and capable of expanding and contracting to caulk the lid skirt of the sealed container, a pusher capable of rising and falling, provided on an upper side of the annular coil spring, having a tapered spring pressing inner circumferential surface inclining toward an upper center at its lower end that can reduce a diameter of the annular coil spring when lowering, and a container mouth pressing means provided in the fitting recess of the cylindrical holder, including a container mouth pressing member at its lower end, urged downward and capable of rising and falling; and a pusher lifting and lowering means for lifting and lowering the pusher of the lid shaping unit, wherein the container lifting and lowering means is a means for lowering the sealed container after performing a first lifting for lifting the sealed container until an upper part or a middle part of the lid skirt is located on an inner side of the annular coil spring and a second lifting for lifting the sealed container until a lower part of the lid skirt is located on the inner side of the annular coil spring, wherein the container lifting and lowering means is a lower cam including a first rising step and a second rising step, the lower cam being engaged with a cam follower provided in the container placing table to guide the container placing table, the pusher lifting and lowering means is a means for, after lowering the pusher until the spring pressing inner circumferential surface reduces the diameter of the annular coil spring, lifting the pusher until the spring pressing inner circumferential surface releases the annular coil spring from the diameter reduction, wherein the pusher lifting and lowering means is an upper cam including a falling step provided between the first rising step and the second rising step, the upper cam being engaged with a cam follower provided in the pusher of the lid shaping unit to guide the pusher, and the device operates in the order of the first lifting of the sealed container, the lowering of the pusher, the second lifting of the sealed container, the lifting of the pusher, and the lowering of the sealed container.

3. The liquid filling and packaging machine according to claim 2, wherein the sealing device is an ultrasonic sealing device that, while the container body on which the molded lid is placed rotationally moves, ultrasonically seals the upper end opening of the container body with the molded lid to form a sealed container.

4. A method for producing a lid shaped sealed container comprising shaping a lid skirt using a lid shaping device, after covering a bottomed cylindrical container body made of synthetic resin filled with liquid contents with a molded lid made of synthetic resin including the lid skirt suspended from a peripheral edge of a disc-like lid body to hermetically seal the bottomed cylindrical container body, the method comprising:

placing the sealed container on a container placing table;

lifting the sealed container placed on the container placing table with a container lifting and lowering means, fitting the lid skirt of the sealed container in a cylindrical holder fitting recess of a lid shaping unit arranged on an upper side of the container placing table, and locating an upper part or a middle part of the lid skirt of the sealed container on an inner side of an annular coil spring in the cylindrical holder;

lowering a pusher in the cylindrical holder with a pusher lifting and lowering means in a state in which the upper part or the middle part of the lid skirt of the sealed container is located on the inner side of the annular coil spring, reducing a diameter of the annular coil spring with a spring pressing inner circumferential surface, and caulking the lid skirt from an outer side; and further lifting the sealed container with the container lifting and lowering means in a state in which the lid skirt is caulked from the outer side by the annular coil spring, and caulking a lower part of the lid skirt with force stronger than the caulking in the pusher lowering step, wherein the container lifting and lowering means is a lower cam including a first rising step and a second rising step, the lower cam being engaged with a cam follower provided in the container placing table to guide the container placing table, and the pusher lifting and lowering means is an upper cam including a falling step provided between the first rising step and the second rising step, the upper cam being engaged with a cam follower provided in the pusher of the lid shaping unit to guide the pusher.

5. The method for producing the lid shaped sealed container according to claim 4, further comprising, after the further lifting step, a step of retaining a state in which a lower end of the lid skirt is pressed from an outside with the annular coil spring.

* * * * *